US005964122A

United States Patent [19]

Bonnard et al.

[11] Patent Number: 5,964,122

[45] Date of Patent: Oct. 12, 1999

[54] DUAL CONTROL DEVICE FOR SELECTIVELY ACTUATING THE BRAKE AND/OR CLUTCH AND/OR ACCELERATOR OF A DRIVING SCHOOL VEHICLE

[76] Inventors: Henri Bonnard, 7, rue Maryse-Hiltz, Velizy F-78140; Francisco Rivas, 9, impasse de la Resistance, Bruguieres F-31150; Michel Santalucia, Rue de Borde-Blanche, Brax F-31490, all of France

[21] Appl. No.: 08/765,733

[22] PCT Filed: Jul. 13, 1995

[86] PCT No.: PCT/FR95/00943

§ 371 Date: Mar. 18, 1997

§ 102(e) Date: Mar. 18, 1997

[87] PCT Pub. No.: WO96/02875

PCT Pub. Date: Feb. 1, 1996

[30] Foreign Application Priority Data

Jul. 13, 1994 [FR] France ..... 94 08938

[51] Int. Cl.[6] ..... G05G 1/14

[52] U.S. Cl. ..... 74/473.12; 477/71; 477/170; 74/562.5; 74/473.15

[58] Field of Search ..... 477/71, 78, 170; 74/470, 471 R, 562.5, 512, 479.01, 473.12, 473.15, 473.17; 192/30 W, 84.6

[56] References Cited

U.S. PATENT DOCUMENTS

| | | | |
|---|---|---|---|
| 2,599,656 | 6/1952 | Ostrow | 74/562.5 |
| 3,174,359 | 3/1965 | Rose | 74/562.5 |
| 3,435,703 | 4/1969 | Allgaier | 74/562.5 |
| 3,661,033 | 5/1972 | Stantus | 74/562.5 |
| 4,312,246 | 1/1982 | Barresi | 74/562.5 |
| 4,618,040 | 10/1986 | Honma et al. | 477/71 |
| 4,915,075 | 4/1990 | Brown . | |
| 5,095,434 | 3/1992 | Lupo et al. | 477/78 |
| 5,309,361 | 5/1994 | Drott et al. . | |
| 5,603,674 | 2/1997 | Rivas et al. | 477/170 |

FOREIGN PATENT DOCUMENTS

WO92/05482 4/1992 WIPO .

*Primary Examiner*—Dirk Wright
*Assistant Examiner*—Peter T. Kwon
*Attorney, Agent, or Firm*—Harrison & Egbert

[57] ABSTRACT

A dual control device for selectively actuating a brake, a clutch or an accelerator of a driving school vehicle having at least one mechanical sensor which generates an electrical signal corresponding to an action of a foot of the user. An electrical circuit receives this electrical signal so as to actuate on electric motive member. The electric motive member has an output mechanical element affixed to an end of an actuating flexible element and connected to one of the pedals. The output mechanical element applies an axial stress on the flexible element when the motive member is actuated. The axial stress applied to the flexible element being applied onto the pedal so as to pull the pedal toward the floor of the vehicle.

17 Claims, 4 Drawing Sheets

FIG. 6
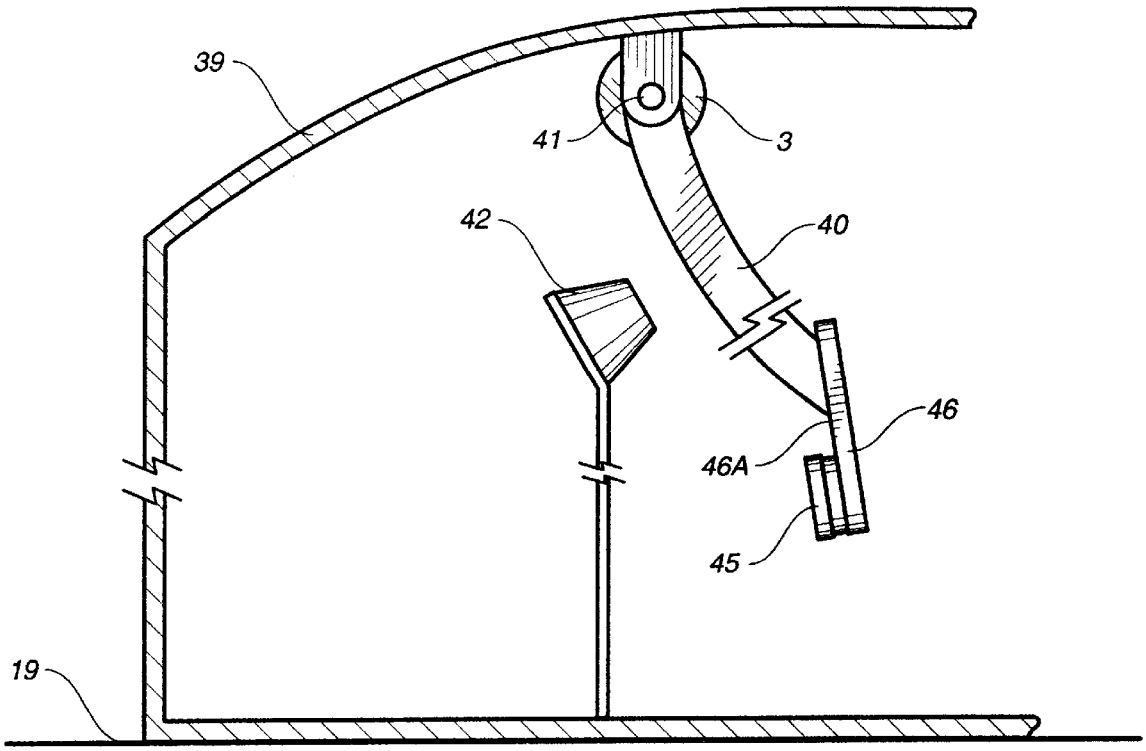
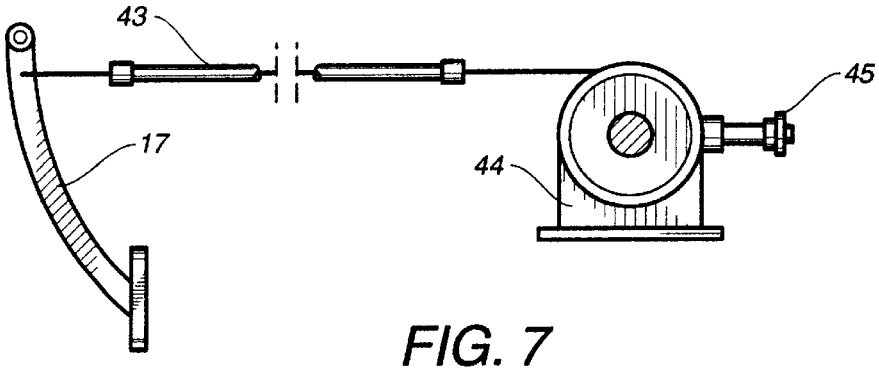
FIG. 7

DUAL CONTROL DEVICE FOR SELECTIVELY ACTUATING THE BRAKE AND/OR CLUTCH AND/OR ACCELERATOR OF A DRIVING SCHOOL VEHICLE

TECHNICAL FIELD

The present invention relates to a dual control device for driving school vehicles.

BACKGROUND ART

The currently known devices are each constituted by a double toe board comprising an assembly of rods with activating pedals which make it possible to double the functions of the pedals for driving the vehicle. Thus, with the pedals of this additional toe board, it is possible to brake the vehicle, act on the clutch and on the accelerator. These devices require a long installation period and are specific to each type of vehicle. In addition, they have numerous disadvantages, including the following:

- uncertain reliability of the controls of the double toe board;
- the passage of the rods can result in deterioration of the linings of the vehicle;
- the space requirement is substantial and prevents stretching of the legs in the passenger/instructor area;
- the modification of the vehicle is extensive, and refurbishing the vehicle for resale is made difficult;
- the management of the specific parts is heavy due to their adaptation to each model,
- the reuse of dual control equipment is non-existent (wear and tear, deformation).

SUMMARY OF THE INVENTION

The present invention proposes a device which provides a solution to the aforementioned disadvantages. In addition, the present invention is a device that has the advantage of being assembled, disassembled, and reassembled at will, even on vehicles of different models and makes.

To this end, the dual control device, object of the present invention, which selectively actuates the brake and/or clutch and/or accelerator of a driving school vehicle, is essentially characterized in that it comprises at least one mechanical sensor, i.e., a sensor that can be activated by mechanical load, generating an electrical signal representing the action or stress of the feet of a user, such as the instructor, one electrical control circuit receiving, via an electrical connection, the signal representing said action, and at least one electric motive member, electrically connected to the electrical control circuit and activated by the circuit when the latter receives the signal representing the foot action applied by the instructor on the sensor, the electric motive member comprising an output mechanical element affixed to the end of an actuating flexible mechanical element, fixed through its other end to the brake pedal or to the clutch pedal, or to the accelerator pedal, the output member applying an axial stress on the actuating flexible element when the motive member is actuated, the axial stress exerted on the flexible element being applied by this same element on the pedal, which actuates the latter toward the floor of the vehicle.

The dual control device is especially adapted to equip a driving school automobile in order to efficiently double the braking, engaging, and accelerating functions. Thus, the invention, according to another aspect thereof, provides three mechanical sensors adapted to actuating the functions of braking, engaging and accelerating the vehicle, respectively, electrically connected to the electrical control circuit and providing signals representing the actions of the user's feet to the electrical control circuit, which is electrically connected to three electric motive members, which are actuated by the control circuit, from the action on the three sensors, respectively, the three motive members being mechanically associated, via the three actuating flexible elements, with the three pedals of the vehicle, respectively, which pedals are each actuated toward the floor of the vehicle by the associated flexible element, when the corresponding motive member is actuated by the electrical control circuit.

The actuating flexible elements can be each constituted by a cable slidably mounted in a steel spiral flexible sleeve. Such a flexible element is known as the BOWDEN™ wire. The cable of this flexible element will be fixed, through one of its ends, to the corresponding pedal, for example, and the latter will be actuated by this cable in traction toward the floor of the vehicle.

According to this embodiment, a sleeve stop-box pivotally mounted on a base for attachment to the floor of the vehicle is associated with each of the actuating flexible elements, across from and in front of the corresponding pedal, so as to follow the movement of the latter and allow for the self-orientation of the cable along the direction of the tensile force on the pedal, which reduces the wear and tear thereof.

According to an alternative embodiment, the cable, through its free end, is attached to the floor of the vehicle, behind the corresponding pedal, and the latter is equipped with a sleeve stop ring crossed by the cable, in which the end of the sleeve is blocked. According to this embodiment, the actuating flexible element, between the actuating motive member and the corresponding pedal, is arranged along a path having at least one curve.

According to a first embodiment, the driving school instructor has, to control the three pedals, a small width plate provided with three buffers associated mechanically with the three sensors, respectively, which are attached to this plate.

The pedal engagement set-point is directly proportional to the pressure applied by the foot of the instructor on the buffer corresponding to the original pedal which, in addition, maintains its initial function.

The amplitude or intensity of the electrical signal delivered by each mechanical sensor represents the value of the pressure applied by the instructor's foot. The output element of each electric motive member is displaced by its motor when the latter is actuated, and the value of its displacement is correlated to the amplitude or intensity value of the electrical signal delivered by the mechanical sensor.

Therefore, the mechanical sensors or foot movement sensors linked to the device, object of the present invention, are pressure sensors, engagement sensors, or position sensors.

According to another embodiment, each sensor is actuated by a pedal, which is specific thereto, mounted to so as to be journalled in a removable support in the form of a box, for example, fixed on the floor of the vehicle, on the front passenger side.

The purpose of this box with pedal is to replace the aforementioned plate. According to this embodiment, each pedal of the box will be mounted on a journal axis supported by a cap fixed to the box. On the path of each pedal, a stop adapted to define the limit of travel will be arranged in the box. In addition, the stop associated with the pedal corresponding to the brake pedal of the vehicle is elastically deformable and delivers to the pedal a reaction force simulating the force exerted by the braking circuit on the brake pedal of the driver when the latter attempts to block the wheels. The sensor associated with the pedal will deliver in this situation, a signal of maximum or quasi-maximum intensity or amplitude, such that the actuating motor, by means of the associated flexible element, will push the pedal back toward the floor, to the end of the travel thereof.

A means of pivotal blockage, that can be activated by the instructor, is associated to each of the pedals of the vehicle, i.e., those that are adapted to be actuated by the driving student, in order to prevent, when necessary, the maneuvering of this pedal toward the floor. In a variation, a blocking means for each pedal is no longer provided to prevent the mishandling thereof by the student, but a vibrator that can be activated by the instructor.

Preferably, each electric motive member is a back-geared motor. Each back-geared motor comprises a winch on which the cable of the flexible element of the associated pedal is wound, this winch constituting the output element of the electric motive member. A potentiometer for locating the angular position of the winch and, consequently, the degree of engagement of the pedal, is associated with this winch or to one the gears of the back-geared motor constituting the transmission of movement between the winch and the motor shaft.

BRIEF DESCRIPTION OF THE DRAWINGS

Other advantages, objects, and characteristics of the invention will become apparent upon reading the description of a preferred embodiment, provided by way of a non-limiting example, with reference to the annexed drawings, in which:

FIG. 6 is a view of a box with pedals for activating the sensors controlling the engagement of the driving pedals of the vehicle;

FIG. 7 is a schematic view of a means for blocking each driving pedal of the vehicle.

DETAILED DESCRIPTION OF THE INVENTION

Figure 1:
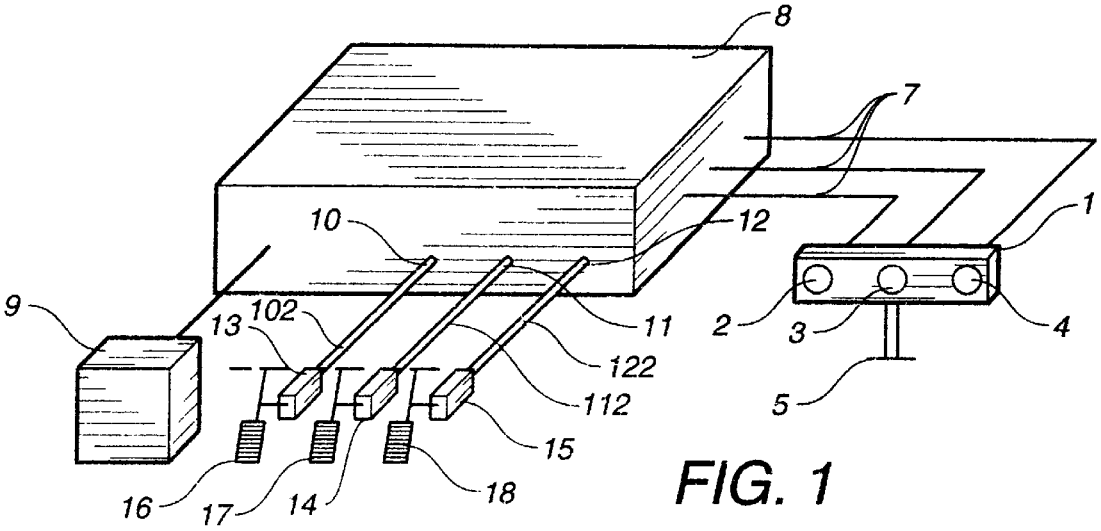
FIG. 1 is a schematic perspective view of the device according to the invention.

FIG. 1 shows a control plate 1 comprising three sensors 2, 3, and 4, and supported by a support 5 connected to the floor of the vehicle 6, or directly fixed to this floor, connecting electrical conductors 7, a motor housing 8 electrically connected to a power supply 9 by supply electrical conductors, and to the sensors 2, 3, 4 by the electrical conductors 7. Furthermore, the motor housing 8, comprising the electric motive members 22, 23, 24 is mechanically connected to three flexible, mechanical elements 10, 11, and 12 each constituted, for example, by a BOWDEN™ wire. These BOWDEN™ wires are each constituted by a steel cable slidably mounted in a guide sleeve. The element 10 is constituted by a cable 101 and a sleeve 102. The element 11 is constituted by a cable 111 and a sleeve 112, and the element 12 is constituted by a cable 121 and a sleeve 122. These elements 10, 11, 12 are respectively engaged in three sleeve stop-boxes 13, 14, and 15, and connected to the three driving pedals 16, 17, and 18, respectively. The driving pedal 16 is the clutch pedal of the vehicle 6. The driving pedal 17 is the brake pedal of the vehicle. The driving pedal 18 is the accelerator pedal of the vehicle 6. More specifically, the output mechanical elements of the electric motive members fixedly receive the three cables 101, 111, 121, respectively, of the actuating flexible elements 10, 11, 12. To actuate the pedals, the output mechanical elements of the electric motive members act in traction on the actuating flexible elements.

The control plate 1 is, for the driving school instructor, the equivalent of the driving pedals 16, 17, 18 for the student. The engagement or pressure sensors 2, 3 and 4 correspond to the three driving pedals 16, 17, and 18, respectively. The plate thus serves to control the vehicle 6, concurrently with the action of the student. For reasons related to ergonomics, the lateral distance between the sensors 2, 3, and 4 is substantially equal to that separating the pedals 16, 17, and 18. The control plate 1 only serves as a rigid support for the sensors 2, 3, and 4, and is itself supported, for example, by a support 5 which moves it away from the floor of the vehicle 6, according to the most appropriate position for the instructor's comfort.

The sensors 2, 3, and 4 are each capable of transmitting an electrical signal depending on the action of the foot on their surface. These sensors can, for example, be movement sensors constituted by potentiometers, for example, engagement sensors or position sensors. They are of a known type. These sensors are protected by a buffer made of a plastic, elastic, or rubber material. The sensors 2, 3, and 4 are each capable of emitting an electrical signal representing the movement, the position or the force exerted on their surface by the instructor's foot.

The connecting electrical conductors 7 electrically connect the sensors 2, 3, and 4 to the motor housing 8 and transmit the signals exiting from the sensors 2, 3 and 4.

Figure 4:
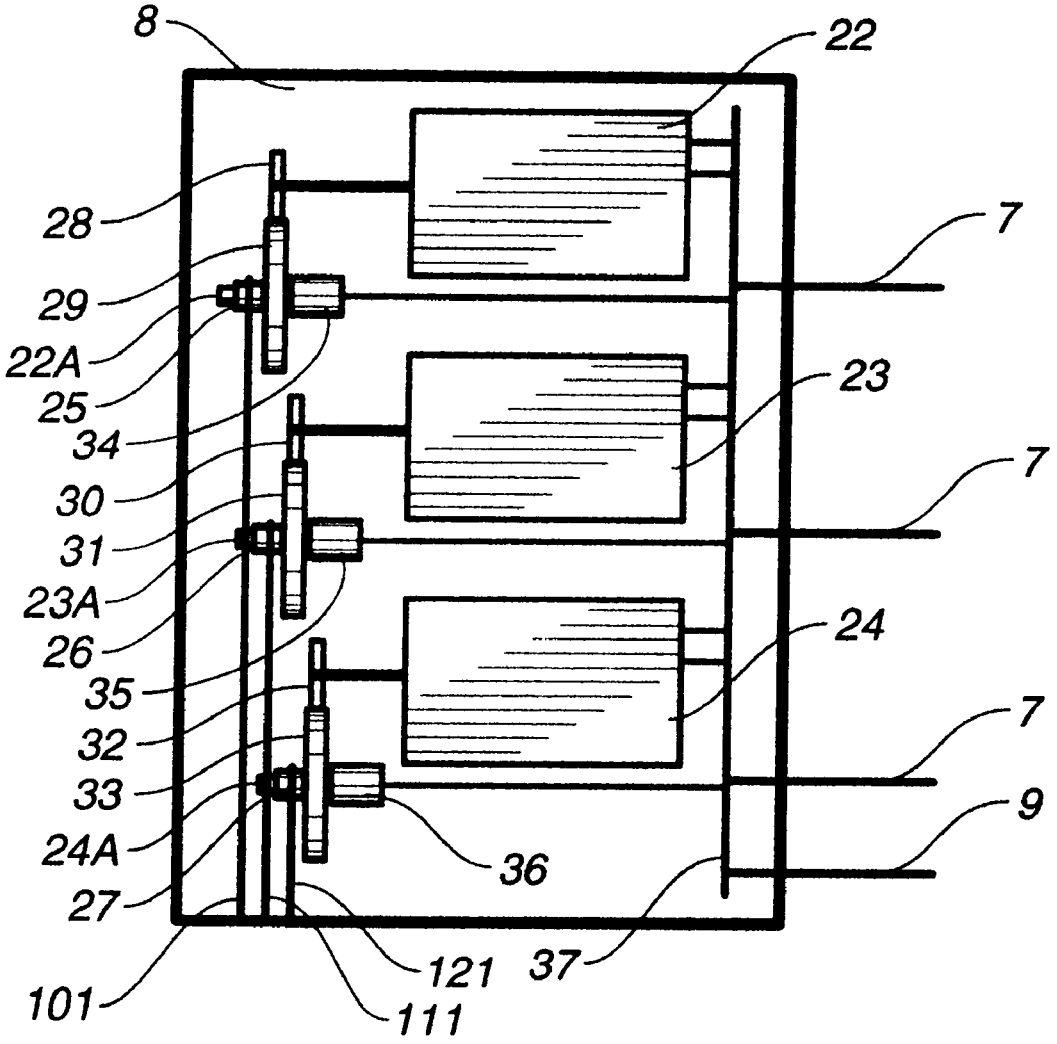
FIG. 4 is a top view of a motive portion of the device shown in FIG. 1.

The motor housing is shown in FIG. 4. It comprises three back-geared motors controlled as a function of the signals exiting from the sensors 2, 3, and 4, and controlling the position of the driving pedals 16, 17, and 18. Therefore, it receives the connecting electrical conductors 7 and the power supply at the input, and controls the position of the three cables 101, 111, 121 of the flexible elements 10, 11, and 12 at the output.

The power supply 9 is preferably constituted by the storage battery of vehicle 6.

The three actuating flexible mechanical elements 10, 11, and 12 engage three sleeve stop-boxes 13, 14, and 15, respectively. The three sleeve stop-boxes 13, 14, and 15 are located in front the pedals 16, 17, and 18, respectively; and are fixed on the floor of the vehicle 6. Each sleeve stop-box receives, from the motor housing 8, one of the elements 10, 11, or 12 comprising the external sleeve and the central cable, and only the central cable exits therefrom which is mechanically linked to the lower surface of the corresponding pedal. In this way, a traction exerted on the central cable by one of the back-geared motors causes the engagement of one of the driving pedals 16, 17 or 18.

The driving pedals 16, 17, and 18 are the original pedals of the vehicle.

Figure 5:
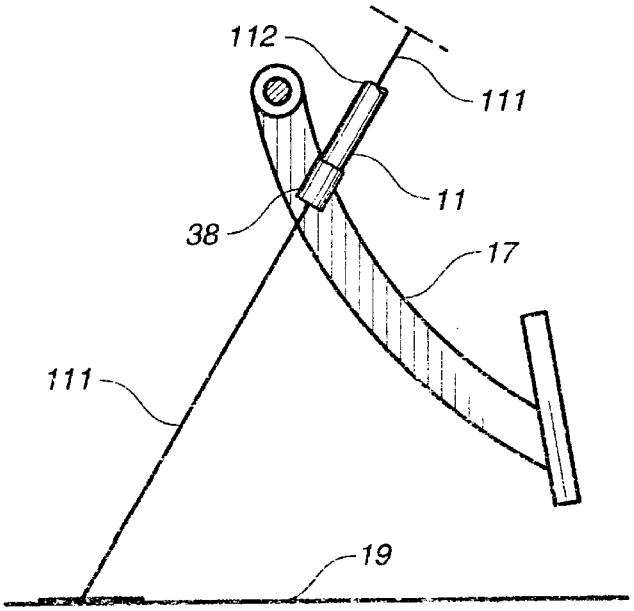
FIG. 5 is a detailed view showing the linkage between an actuating flexible element and the corresponding pedal according to another embodiment.

Each sleeve-stop box is pivotally mounted about an axis 20 on a base 13A for attachment to the floor 19 of the vehicle, across from and in front of the corresponding pedal. The sleeve stop-box comprises an internal channel 13B extending from an inlet opening for the cable and its sleeve toward a cable outlet opening provided in the front surface of said box, i.e., that positioned opposite the pedal. In the internal channel 13B of the box are introduced the cable and its sleeve, and the latter is blocked through its end in the channel, against a shoulder thereof, for example. The inlet opening for the cable and its sleeve is provided in one of the lateral surfaces of the box, this surface being perpendicular to the fulcrum pin. The internal channel 13B of the box 13 develops along an arc of circumference of a circle with a relatively substantial radius. The fulcrum pin 20 of the box 13 is parallel to the fulcrum pin of the corresponding pedal, and the geometrical center of the outlet opening is part of the geometrical plane in which the fastening of the cable to the pedal develops. Thus, when the pedal is tractionally biased, the box can freely pivot and the cable can be oriented along the direction of the tensile force on the pedal, which limits the attrition on the edge of the outlet opening. Furthermore, the cable, due to this arrangement, will not be subject to shearing forces at the level of the outlet opening. According to this embodiment, the cable of the actuating flexible element fractionally actuates the corresponding pedal. According to an alternative embodiment shown in FIG. 5, the cable of the actuating flexible element is fixed to the floor of the vehicle through its end, behind the corresponding pedal, and the latter fixedly receives a sleeve stop ring 38 crossed by the cable, in which the end of the sleeve of the flexible element is blocked. The actuating flexible element, between the actuating motive member and the corresponding pedal, is arranged along a path having at least one curve, and the element is mounted in the vehicle so as to be capable of displacing therein freely. Thus, when the corresponding actuating motive member act in traction on the cable, the curve formed by the flexible element can be reduced, which forces the sleeve to apply a thrust on the pedal.

The driving school instructor has, to control the three pedals, a small width plate provided with three buffers. The pedal engagement set value is directly proportional to the pressure applied the foot of the instructor on the buffer corresponding to the original pedal.

The sensor 2 is functionally associated with the driving pedal 16 and to the actuating flexible element 10. The sensor 3 is functionally associated with the driving pedal 17 and to the actuating flexible element 11. The sensor 4 is functionally associated with the driving pedal 18 and to the actuating flexible element 12. The actuating flexible elements 10, 11 and 12 are mechanically associated with the three sleeve stop-boxes 13, 14, 15, respectively.

Figure 2:
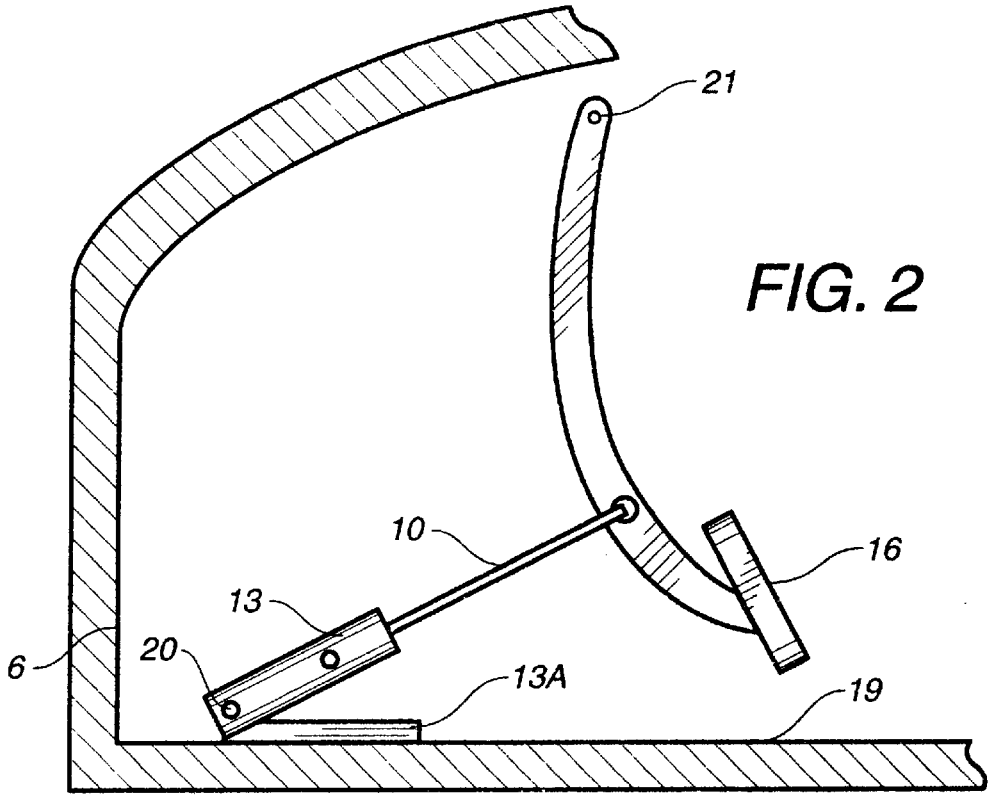
FIG. 2 is side view of a pedal of the vehicle and of a sleeve stop-box of the device according to the invention.

FIG. 2 shows a sleeve stop box 13 comprising a fulcrum pin 20, an actuating flexible element 10, the floor 19 of the vehicle 6, and a driving pedal 16 linked to an axis or rotation 21. It is understood that the tensioning of the cable of the actuating flexible element 10 causes the lowering of the driving pedal 16 toward the fulcrum pin 20.

Figure 3:
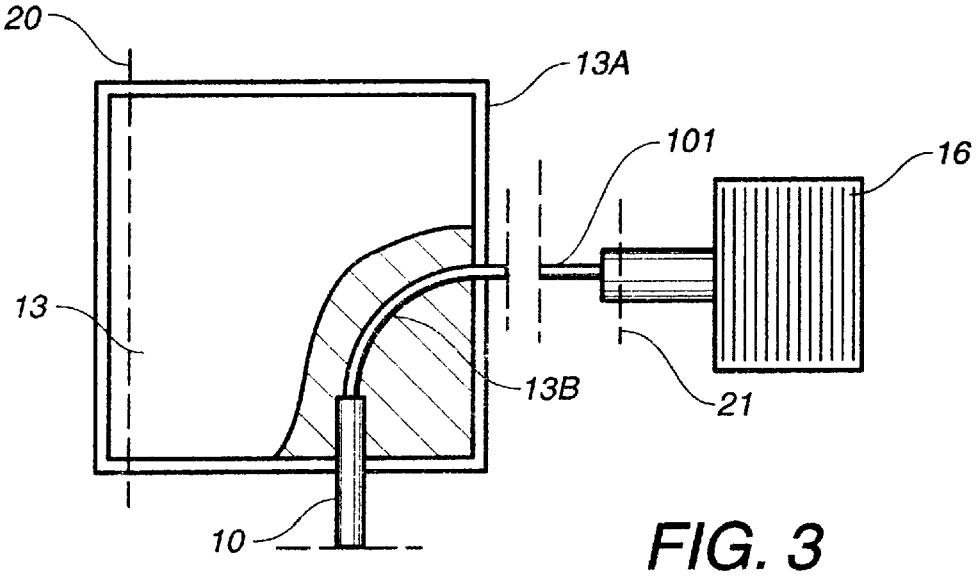
FIG. 3 is top view of a pedal and of a sleeve stop-box of the device according to the invention.

FIG. 3 shows a sleeve stop box 13, a fulcrum pin 20, the actuating flexible element 10, the floor 19 of the vehicle 6, and the driving pedal 16 linked to the axis of rotation 21. FIG. 3 shows, in a top view, the same elements as FIG. 2 and does therefore not require any complementary explanation.

It is understood that the tensioning of the cable of the actuating flexible element 10 causes the lowering of the driving pedal 16 toward the pivotal axis 20.

FIG. 4 shows, in a top view, the motor housing 8, the electrical conductors 7, the mechanical cables 101, 111, and 121, the power supply 9. The motor housing 8 comprises three electric motive members 22, 23, and 24, three position sensors 34, 35, and 36, and an electrical circuit 37 connected to all of the electrical elements in the device according to the invention. Each electric motive member is constituted, for example, by a back-geared motor and comprises an output mechanical element to which one of the three tensile mechanical elements 101, 111, 121 is fixed. Each back-geared motor comprises an electric motor of the type of those having a rotating output shaft on which a mechanical torque is available, and a reducer coupled to the output shaft of the electric motor by means of a strap or other coupling means, the reducer being provided with an output shaft coupled to the mechanical output element of the motive member. The respective output shafts 22A, 23A, and 24A of the reducers are coupled to the output elements 25, 26 and 27, respectively, of the three motive members, the output elements being each constituted by a winch. The cables 101, 111, 121, respectively, of the actuating flexible elements 10, 11, and 12 are wound on the three winches, and therefore cause the lowering of the driving pedals 16, 17, and 18, respectively.

Each reducer is constituted, for example, by two gears with different pitch diameters, in mesh with one another, one of which is wedged on the output shaft of the corresponding motor, and the other on the corresponding output shaft 22A, 23A or 24A, the gear with the larger pitch diameter being wedged on the latter shaft. In FIG. 4, one can note that the reducer constituted by the gears 28 and 29 is coupled to the shaft 22A of the motive member 22 and delivers a torque to the winch 25, whereas the reducer constituted by the gears 30 and 31 is coupled to the output shaft 23A and cooperates in a coupling with the winch 26. One also notes that the reducer constituted by the gears 32 and 33 is coupled to the shaft 24A and cooperates in a coupling with the winch 27.

The three position sensors 34, 35 and 36 are mechanically connected to the shafts of the motive members, to the gears of the reducers or to the winches. They are capable of having a variable electrical response depending on their mechanical position. They are, for example, constituted by potentiometers having a variable resistance as a function of this position, or else of the driving pedals.

The electrical circuit 37 controls the position of the driving pedal 16 as a function of the signal which it receives from the sensor 2, by performing a verification of position via the potentiometer 34. Likewise, the electrical circuit 37 controls the position of the driving pedal 17 as a function of the signal which it receives from the sensor 3, by performing a verification of position via the potentiometer 35. Finally, the electrical circuit 37 controls the position of the driving pedal 18 as a function of the signal which it receives from the sensor 4, by performing a verification of position via the potentiometer 36.

The electronic chart of the electrical circuit 37 is known to one skilled in the art, in the field of follow-up controls.

An electroacoustic transducer with an appropriate electrical circuit could be provided for an on-off functioning electrically connected to the sensors 2, 3, 4, such that sound information is provided which indicates the action of the instructor on one of the three controls. Likewise, an electroacoustic transducer with an appropriate electrical circuit could be provided to advise the instructor of the action of the student on the driving pedals 16, 17, 18. Furthermore, repetition of the electric controls such as warning light, turning lights, horn, low beam, headlights, will be remotely controlled by a free box.

In the embodiment, object of FIG. 6, the sensors 2, 3, 4, are no longer borne by a plate but are fixedly mounted in a case 39 removably fixed on the floor of the vehicle on the passenger's side, and open in the direction of the passenger's seat. Three pedals 40 are mounted to be journalled in this case, the first of which actuates the sensor 2, the second the sensor 3, and the third the sensor 4. Each pedal 40 is fixedly mounted on a journal axis 41 rotatably mounted in a cap 42 fixed to the case 39. The sensor 2, 3 or 4 associated with the corresponding pedal 40 will be of the type of those comprising a rotating axis and delivering an intensity or signal representing the angular position of the axis with respect to an original position. This sensor will be coupled to the journal axis 41 to deliver an information representing the angular position of the associated pedal. Each pedal 40 is displaceable toward the floor of the vehicle under the effect of the thrust force exerted by the instructor's foot. A return spring (not shown) mounted so as to be tensioned between the box and the pedal is provided to bring each pedal back to the original position.

The three pedals 40 correspond to the accelerator pedal 8, to the brake pedal 17, and to the clutch pedal 16, respectively, and are associated to the sensors 4, 3, and 2, respectively. Along the path of each pedal 40, a stop adapted to define the limit of travel of this pedal is fixedly mounted in the case 39. The stop 42 associated with the pedal of the box corresponding to the brake pedal 17 is shaped like a truncated buffer and deforms elastically under the effect of the action of the corresponding pedal 40. By reaction to the force applied by the pedal 40, this stop 42 applies on the pedal 40 a reaction force which simulates that exerted by the hydraulic braking circuit on the pedal 17, when the latter is pushed back by the driver to end of its travel.

A means for pivotal blocking, which can be activated by the instructor, can be associated with each of the pedals 16, 17, 18, in order to prevent the student from manoeuvering this pedal, if necessary. This means can be constituted by a actuating flexible element 43 fixed, on the one hand, to the corresponding pedal 16, 17 or 18 and, on the other hand, to an activating electric motive motor 44 which, when activated, act in traction on the flexible element to maintain the corresponding pedal by traction on the latter by means of the element, in the farthest position from the floor, and to prevent it from being manoeuvered toward the latter. The signal for activating the electric motive member will be delivered by a sensor 45 fixedly mounted against the inner surface 46A of the manoeuvering buffer 46 of the pedal 40. This sensor 45 will deliver the activation signal when actuated by the instructor's foot.

As an alternative embodiment, the blocking means is replaced by a vibrator, known in itself, that can be activated by the activation signal delivered by the sensor 45.

Finally, it must be noted that the positioning of the device according to the invention in the vehicle requires little equipment and is thus facilitated. Furthermore, the use of shielded cable, to actuate the pedals of the vehicle, makes it possible to place the motor housing 8 at a distance from the pedals in the most appropriate location. Thus, this housing can be placed under the driver's seat, in the trunk of the vehicle, or in any other available location.

It is understood that the present invention can receive any accommodations and variations in the field of technical equivalents, without leaving the scope of the present invention.

We claim:

1. A dual control device for selectively actuating a brake pedal or a clutch pedal or an accelerator pedal of a driving school vehicle, the device comprising:

at least one mechanical sensor means which is actuable by a mechanical load, said mechanical sensor means for generating an electrical signal representing an action of a foot of a user;

an electrical control circuit receiving through an electrical connection said electrical signal representing the action; and at least one electrical motive means electrically connected to said electrical control circuit, said electrical motive means being activated by said circuit when said circuit receives said signal representing the foot action of the user on said sensor means, said electrical motive means comprising an output mechanical means affixed at one end to an end of an actuating flexible element, said actuating flexible element affixed at another end to one of the pedals, said output mechanical means for applying an axial stress on said actuating flexible element when said electrical motive means is actuated, the axial stress exerted on said actuating flexible element being applied by said actuating flexible element onto said one of the pedals so as to pull said one of the pedals toward a floor of the vehicle.

2. The device according to claim 1, said at least one mechanical sensor means comprising three mechanical sensors adapted to activate a clutching function and a braking function and an accelerating function, respectively, of the vehicle, said three mechanical sensors electrically connected to said electrical control circuit so as to provide signals representing actions of feet of the user to said electrical control circuit, said electrical control circuit being electrically connected to said electrical motive means, said electrical motive means comprising three electric motive members respectively actuated by said electrical control circuit from said three mechanical sensors, said three electric motive members being mechanically connected through three actuating flexible elements with three pedals, respectively, each of the three pedals being actuable toward the floor of the vehicle by the flexible element associated therewith when a corresponding motive member is activated by the electrical control circuit.

3. The device according to claim 2 wherein each electric motive member comprises a back-geared motor having gears to which said output mechanical means is coupled, said output mechanical means being connected to a corresponding actuating flexible element, said output mechanical means being a winch.

4. The device according to claim 2 wherein said three mechanical sensors are pressure sensors.

5. The device according to claim 2 wherein said three mechanical sensors are position sensors.

6. The device according to claim 2 further comprising a position sensor means connected to each of said three electric motive members, said position sensor means having a variable electrical response depending on a position of the electric motive member, said position sensor means electrically connected to said electrical control circuit.

7. The device according to claim 6 wherein said position sensor means comprises a potentiometer having an electrical resistance which is variable as a function of the position of the electric motive member.

8. The device according to claim 6 wherein said electrical control circuit controls a position of said three actuating flexible elements as a function of an electrical response of said position sensor means.

9. The device according to claim 2 wherein each of said three actuating flexible elements comprise a cable slidably mounted in a sleeve.

10. The device according to claim 9 further comprising a sleeve stop-box pivotally mounted about a pin on a base for attachment to the floor of the vehicle, said sleeve stop-box being associated with each of said three actuating flexible elements across from and in front of the corresponding pedal so as to follow a movement of the corresponding pedal and to allow for self-orientation of said cable along a direction of a tensile force on the corresponding pedal.

11. The device according to claim 10 wherein said sleeve stop-box comprises an internal channel in which said cable and said sleeve are inserted, said internal channel extending from an inlet opening and said sleeve toward an outlet opening for only said cable, said outlet opening formed in a front surface of said box, said sleeve being blocked in said channel against a shoulder thereof, said inlet opening being provided in a lateral surface of said stop-box, said lateral surface being perpendicular to a fulcrum pin, said fulcrum pin being parallel to a fulcrum pin of the corresponding pedal, said outlet opening having a geometrical center coplanar to a plane of the connection of said cable to the corresponding pedal such that when the corresponding pedal is tractionally biased the stop-box can pivot freely and said cable is oriented along the direction of the tensile force on the corresponding pedal.

12. The device according to claim 9 wherein said cable has a free end attached to the floor of the vehicle behind a corresponding pedal, the corresponding pedal having a sleeve stop ring crossed by said cable in which an end of said sleeve is blocked.

13. The device according to claim 2 wherein said three mechanical sensors are arranged on a plate.

14. The device according to claim 2 wherein each of said three mechanical sensors is actuated by a corresponding pedal, the corresponding pedal being journalled in a removable support mounted on the floor of the vehicle, a stop is positioned on a path of the corresponding pedal so as to define a limit of travel of the corresponding pedal.

15. The device according to claim 14 wherein said stop is elastically deformable so as to deliver a reaction force to the corresponding pedal, the reaction force simulating a force exerted upon the brake pedal.

16. The device according to claim 2 further comprising a pivotal blocking means associated with each of the pedals, said pivotal blocking means for blocking a movement of the pedal toward the floor of the vehicle.

17. This device according to claim 2 further comprising a vibrator attached to each of the pedals.

* * * * *

UNITED STATES PATENT AND TRADEMARK OFFICE

CERTIFICATE OF CORRECTION

PATENT NO. : 5,964,122

DATED : October 12, 1999

INVENTOR(S) : BONNARD, Henri; RIVAS, Francisco; SANTALUCIA, Michel

It is certified that error appears in the above-identified patent and that said Letters Patent is hereby corrected as shown below:

On the title page: Item [73]

--Assignee: Sereso Holding, S.A., Cornebarrieu, France.--.

Signed and Sealed this

Fifteenth Day of August, 2000

*Attest:*

*Attesting Officer*

Q. TODD DICKINSON

*Director of Patents and Trademarks*